United States Patent [19]

Lindahl

[11] 4,210,089

[45] Jul. 1, 1980

[54] ROUNDSLING

[75] Inventor: Bengt E. Lindahl, Göthenburg, Sweden

[73] Assignee: Svensk Lasthantering Bengt Lindahl AG, Torslanda, Sweden

[21] Appl. No.: 21,806

[22] Filed: Mar. 19, 1979

Related U.S. Application Data

[63] Continuation of Ser. No. 832,726, Sep. 12, 1977, abandoned.

[51] Int. Cl.[2] ..... D05B 93/00

[52] U.S. Cl. ..... 112/417; 112/420; 190/57; 294/74

[58] Field of Search ..... 112/420, 421, 417, 440, 112/441, 400; 36/78; 190/57, 59, 18 R; 294/74

[56] References Cited

U.S. PATENT DOCUMENTS

| | | | |
|---|---|---|---|
| 718,906 | 1/1903 | Bunnell | 112/420 X |
| 1,743,624 | 1/1930 | Schemmel | 112/421 X |
| 1,745,449 | 2/1930 | Poor | 294/74 |
| 1,926,500 | 9/1933 | Sackner | 112/420 |
| 1,950,999 | 3/1934 | Sackner | 112/420 X |
| 2,628,695 | 2/1953 | Rognsvoog | 190/57 |
| 3,405,674 | 10/1968 | Coates et al. | 112/420 |
| 3,805,720 | 4/1974 | Hunt | 112/420 |

*Primary Examiner*—H. Hampton Hunter
*Attorney, Agent, or Firm*—Harness, Dickey & Pierce

[57] ABSTRACT

A lifting sling comprising a core of parallel yarns enclosed by a protective cover, the edges of which are interconnected by a lengthwise seam penetrating diametrically through the sling core so as to divide the latter into two portions, one on each side of the seam. In a direction perpendicular to a line interconnecting the centers of said portions, the cross-sections of said portions considerably exceed the cross-section of the sling in the area of the seam, whereby during use of the sling, the seam will be protected against wear and the stress taken by said two core portions.

1 Claim, 1 Drawing Figure

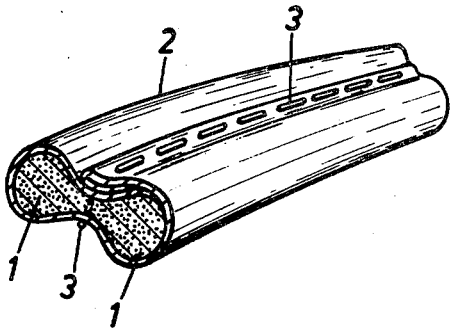
2
3
1
3
1

ROUNDSLING

This is a continuation of application Ser. No. 832,726, filed Sept. 12, 1977 and now abandoned.

BACKGROUND OF THE INVENTION

The present invention concerns lifting loops or slings designed to lift goods, particularly heavy goods, of the kind comprising a core of parallel threads or yarns which are covered by a protecting cloth.

Lifting slings of this kind are generally manufactured by arranging a strip of cloth about a core of the kind mentioned, whereupon the edges of the strip are sewn together along a generatrix of the essentially cylindrically shaped sling thus formed, whereby the core will be tightly enclosed by the cloth. Because the conditions of use of the sling make it particularly desirable that the seam does not project beyond the remainder of the periphery of the sling, the sewing together is effected manually, rendering the manufacture of slings of this kind rather expensive.

According to prior-art manufacturing methods flat lifting slings are produced by arranging a protective cover about a flat core of threads or yarns and, instead of sewing together the protective cover joints directly edge to edge by a seam interconnecting the cover edges in the manner equivalent to that of a hand-sewn sling, thereafter covering the gap formed between the strip edges on one of the flat sides of the sling with a further strip which covers the gap and is narrower than the width of the strip, and then sewing this narrower strip to the rest of the sling by stitches passing through the sling. Such a flat sling, although possessing the advantage of allowing the sewing work to be performed on a machine, suffers from considerable disadvantages in use, particularly because the seams, on account of their positions on the sling and the design of the latter as a whole, are exposed to wear which fairly rapidly makes the sling unfit for use.

SUMMARY OF THE INVENTION

The present invention concerns a lifting loop or sling which to a considerably higher degree possesses the advantages of the roundsling sewn by hand and which in addition thereto has proven to be stronger than prior-art roundslings sewn by hand, given the same consumption of materials, without, however, giving the disadvantages of poor wear resistance found in hitherto known flat slings sewn on a machine. The invention likewise concerns a method of manufacturing the slings of the kind defined.

For this purpose the sling in accordance with the invention is characterised in that the seam extends essentially diametrically through the entire core and cover and in that on each side of the seam are formed portions of the core enclosed by the cover, which portions each has essentially larger cross-sectional dimensions in a direction at right angles to a line interconnecting the centres of the portions than the cross-sectional dimensions of the sling in the area of the seam, said portions on each side of the seam taking the load on said sling and being essential to the strength thereof.

The method of manufacturing the sling in accordance with the invention is characterised in that following enclosing of the core by the cover, the sling is joined together by a seam which passes diametrically through the entire core and the cover while retaining said portions of the core which are essential to the lifting capacity of the sling on each side of the seam, the sewing being performed in such a manner as to ensure that parts of said portions project beyond the seam in a direction perpendicular to a line interconnecting the centres of gravity of said parts.

BRIEF DESCRIPTION OF THE DRAWINGS

The invention will be described in more detail in the following, reference being made to the accompanying drawing which illustrates in a sectional and perspective view a fraction of a complete sling in accordance with the subject invention.

DETAILED DESCRIPTION OF A PREFERRED EMBODIMENT

When manufacturing the sling in accordance with the subject invention one proceeds initially essentially in the same manner as in the manufacture of a roundsling in which the protective cloth strip is arranged about a round core consisting of parallel threads or yarns. Instead of thereafter securing the outer edge of the strip, by hand stitching, to the underlying part of the strip enclosing the core, a seam is sewn, which seam, as mentioned above, cannot be so sewn on a machine of the kind available that the seam will lie flatly against the periphery of the sling and therefore not be easily damaged, this seam in accordance with the teachings of the subject invention being sewn so as to extend essentially diametrically through the sling body consisting of the core and the strip, and in a position adjacent the outer edge of the strip enclosing the core. As a result of suitable dimensions of the strip width in relation to the core dimensions and the tension of the thread, a more or less flat sling is formed which bulges outwards beyond the seam on each side thereof, and in this manner practically totally protects the latter from being damaged during use. The appearance of the completed sling is evident from the drawing wherein the core consisting of parallel threads or yarns is designated by numeral reference 1, the cover by 2 and the seam by 3.

What I claim is:

1. A lifting sling comprising a core consisting of first and second spaced longitudinally extending sections of substantially equal size interconnected by an intermediate longitudinally extending section of lesser dimension, said core being formed from a plurality of longitudinally extending parallel segments, a protective cover enclosing said core and defining an overlapping section, said overlapping section being juxtaposed to the interconnecting section intermediate section of lesser dimension of said core, and a seam extending through said interconnecting intermediate section of lesser dimension and diametrically through the overlapping portion of said cover for securing said cover and said core together, the transverse extent of said seam being substantially less than the corresponding dimension of said first and second core sections so that said seam will not engage a load when said sling bears thereagainst.

* * * * *